US011792581B2

(12) United States Patent
Osman et al.

(10) Patent No.: US 11,792,581 B2
(45) Date of Patent: Oct. 17, 2023

(54) USING BLUETOOTH / WIRELESS HEARING AIDS FOR PERSONALIZED HRTF CREATION

(71) Applicant: Sony Interactive Entertainment Inc., Tokyo (JP)

(72) Inventors: Steven Osman, San Mateo, CA (US); Danjeli Schembri, London (GB)

(73) Assignee: Sony Interactive Entertainment Inc., Tokyo (JP)

( * ) Notice: Subject to any disclaimer, the term of this patent is extended or adjusted under 35 U.S.C. 154(b) by 0 days.

(21) Appl. No.: 17/392,938

(22) Filed: Aug. 3, 2021

(65) Prior Publication Data

US 2023/0041038 A1 Feb. 9, 2023

(51) Int. Cl.
*H04R 25/00* (2006.01)

(52) U.S. Cl.
CPC ..... *H04R 25/554* (2013.01); *H04R 25/405* (2013.01); *H04R 2225/43* (2013.01); *H04S 2420/01* (2013.01)

(58) Field of Classification Search
CPC ..... H04R 25/30; H04R 25/305; H04R 25/43
See application file for complete search history.

(56) References Cited

U.S. PATENT DOCUMENTS

2004/0136541 A1* 7/2004 Hamacher ..... H04R 25/70 381/60
2015/0124975 A1* 5/2015 Pontoppidan ..... G06F 3/162 381/23.1
2016/0112811 A1 4/2016 Jensen et al.
2018/0041849 A1 2/2018 Farmani et al.
2019/0208348 A1* 7/2019 Reijniers ..... H04R 5/02
2020/0336856 A1 10/2020 Khaleghimeybodi et al.

OTHER PUBLICATIONS

"International Search Report and Written Opinion", dated Nov. 22, 2022, from PCT application PCT/US22/73404.

* cited by examiner

*Primary Examiner* — Mark Fischer
(74) *Attorney, Agent, or Firm* — John L. Rogitz; John M. Rogitz

(57) ABSTRACT

A hearing aid that includes a microphone, a signal processor, and a speaker transmits a signal to a computer. The signal transmitted to the computer can be the input to the microphone (before processing) or the output to the speaker (after processing). This enables the capturing of a HRTF that does not or that does include the enhancements of the hearing aids.

20 Claims, 5 Drawing Sheets

Hearing Aid

System

USING BLUETOOTH / WIRELESS HEARING AIDS FOR PERSONALIZED HRTF CREATION

FIELD

The present application relates generally to using Bluetooth/wireless hearing aids for personalized HRTF creation.

BACKGROUND

Binaural or head-related transfer functions (HRTF) are used to modulate the way sounds enter the ear to simulate the effects of real-world variations due to environment, head shape, ear shape, shoulder reflections and so on. As understood herein, one way to create HRTFs is to use small microphones placed inside a person's ear in a special room, typically clad in anechoic coating material. That room is equipped with a number of sound sources that play test tones which are detected by the microphones in the ears.

SUMMARY

Rather than using specialized microphones or a special environment, present principles leverage the fact that some hearing aids already have wireless (e.g., Bluetooth) transceivers built-in to achieve a similar effect. The hearing aid wearer dons a tracking device (for instance, a head-mounted display (HMD)) and walks around a room while audio is played from some fixed speakers, for example from an audio system of TV. This allows capture of the sound source from different angles and distances by the hearing aid microphones as the user walks around, allowing for a personalized HRTF to be computed.

Depending on whether the signal transmitted from the hearing aid is captured at the input end or output end of the hearing aid, HRTFs can be created that ignore or incorporate the effects of the hearing aid. In the latter case, the player can remove the hearing aid when wearing headphones equipped with this personalized HRTF.

Accordingly, present principles are directed to a system with at least one computer medium that is not a transitory signal and that in turn includes instructions executable by at least one processor to receive wireless signals from at least one hearing aid, and based at least in part on the signals, determine a head-related transfer function (HRTF) for a person wearing the hearing aid.

In some examples the hearing aid can include at least one speaker, at least one amplifier configured to send signals to the speaker, at least one microphone configured to provide signals to the amplifier, and at least one wireless transceiver. The hearing aid also may include at least one distal end configured to engage an ear canal of the person. The wireless signals from the hearing aid may represent signals at an output of the microphone (located at an input end of the hearing aid). In such a case the HRTF is useful for processing audio played by a head-mounted device (HMD) worn by the person also wearing the hearing aid.

Or, the wireless signals from the hearing aid may represent signals at an input of the speaker of the hearing aid (located at an output end of the hearing aid). In such a case the HRTF is useful for processing audio played by a head-mounted device (HMD) worn by the person not also wearing the hearing aid.

In example embodiments the instructions may be executable to receive position signals from a head-mounted device (HMD) worn by the person, receive signals from a source of sound at a location and emitting audio detected by the hearing aid, and determine the HRTF based at least in part on the position signals and the signals from the source of sound. The HMD may move during HRTF generation, and the source of sound is stationary as it sends the signals from the source of sound, or the source of sound may move as it sends the signals during generation of the HRTF.

In another aspect, a method includes receiving signals from a hearing aid with an input end and an output end and determining a head-related transfer function (HRTF) for a person wearing the hearing aid. In some examples the signals represent sound at the input end as received from a source while in other examples the signals represent sound at the output end as received from a source.

In another aspect, an assembly includes at least one processor and at least one head-mounted device (HMD) wearable by a person for playing audio from a source of sound for consumption of the audio by the person. The audio is provided by the processor executing a head-related transfer function (HRTF) on the audio, with the HRTF being generated using signals from a hearing aid. The processor may be in the hearing aid, the HMD, the source of sound, or distributed across a combination thereof.

The details of the present application, both as to its structure and operation, can be best understood in reference to the accompanying drawings, in which like reference numerals refer to like parts, and in which:

DETAILED DESCRIPTION

Figure 1:
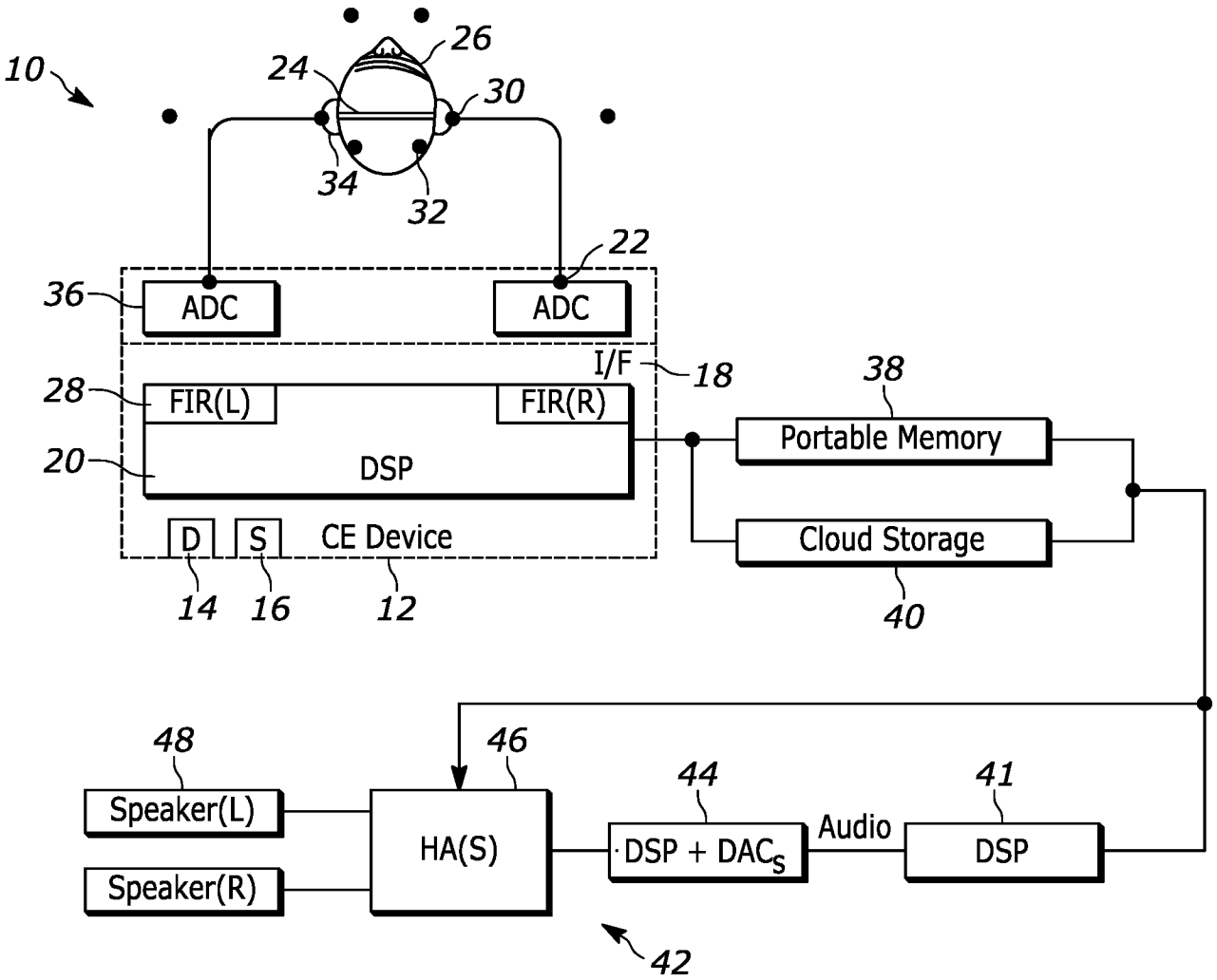
FIG. 1 illustrates an example HRTF recording and playback system.

U.S. Pat. No. 9,854,362 is incorporated herein by reference and describes details of finite impulse response (FIR) filters that can be used for implementing HRTFs. U.S. Pat. No. 10,003,905, incorporated herein by reference, describes techniques for generating head related transfer functions (HRTF) using microphones. U.S. Pat. No. 10,856,097 incorporated herein by reference describes techniques for using images of the ear to generate HRTFs. Co-pending allowed U.S. patent application Ser. No. 16/662,995 incorporated herein by reference describes techniques for modifying a HRTF to account for a specific venue in which sound is played. U.S. Pat. No. 8,520,857, owned by the present assignee and incorporated herein by reference, describes a method for determining HRTF. This patent also describes measuring a HRTF of a space with no dummy head or human head being accounted for.

A HRTF typically includes at least one and more typically left ear and right ear FIR filters, each of which typically includes multiple taps, with each tap being associated with a respective coefficient. By convoluting an audio stream with a FIR filter, a modified audio stream is produced which is perceived by a listener to come not from, e.g., headphone speakers adjacent the ears of the listener but rather from relatively afar, as sound would come from an orchestra for example on a stage that the listener is in front of.

This disclosure accordingly relates generally to computer ecosystems including aspects of multiple audio speaker ecosystems. A system herein may include server and client components, connected over a network such that data may be exchanged between the client and server components. The client components may include one or more computing devices that have audio speakers including audio speaker assemblies per se but also including speaker-bearing devices such as portable televisions (e.g., smart TVs, Internet-enabled TVs), portable computers such as laptops and tablet computers, and other mobile devices including smart phones and additional examples discussed below. These client devices may operate with a variety of operating environments. For example, some of the client computers may employ, as examples, operating systems from Microsoft, or a Unix operating system, or operating systems produced by Apple Computer or Google. These operating environments may be used to execute one or more browsing programs, such as a browser made by Microsoft or Google or Mozilla or other browser program that can access web applications hosted by the Internet servers discussed below.

Servers may include one or more processors executing instructions that configure the servers to receive and transmit data over a network such as the Internet. Or, a client and server can be connected over a local intranet or a virtual private network.

Information may be exchanged over a network between the clients and servers. To this end and for security, servers and/or clients can include firewalls, load balancers, temporary storages, and proxies, and other network infrastructure for reliability and security. One or more servers may form an apparatus that implement methods of providing a secure community such as an online social website to network members.

As used herein, instructions refer to computer-implemented steps for processing information in the system. Instructions can be implemented in software, firmware or hardware and include any type of programmed step undertaken by components of the system.

A processor may be a single- or multi-chip processor that can execute logic by means of various lines such as address lines, data lines, and control lines and registers and shift registers. A processor may be implemented by a digital signal processor (DSP), for example.

Software modules described by way of the flow charts and user interfaces herein can include various sub-routines, procedures, etc. Without limiting the disclosure, logic stated to be executed by a particular module can be redistributed to other software modules and/or combined together in a single module and/or made available in a shareable library. State logic may be employed.

Present principles described herein can be implemented as hardware, software, firmware, or combinations thereof; hence, illustrative components, blocks, modules, circuits, and steps are set forth in terms of their functionality.

Further to what has been alluded to above, logical blocks, modules, and circuits described below can be implemented or performed with a general-purpose processor, a digital signal processor (DSP), a field programmable gate array (FPGA) or other programmable logic device such as an application specific integrated circuit (ASIC), discrete gate or transistor logic, discrete hardware components, or any combination thereof designed to perform the functions described herein. A processor can be implemented by a controller or state machine or a combination of computing devices.

The functions and methods described below, when implemented in software, can be written in an appropriate language such as but not limited to C# or C++, and can be stored on or transmitted through a computer-readable storage medium such as a random access memory (RAM), read-only memory (ROM), electrically erasable programmable read-only memory (EEPROM), compact disk read-only memory (CD-ROM) or other optical disk storage such as digital versatile disc (DVD), magnetic disk storage or other magnetic storage devices including removable thumb drives, etc. A connection may establish a computer-readable medium. Such connections can include, as examples, hard-wired cables including fiber optic and coaxial wires and digital subscriber line (DSL) and twisted pair wires.

Components included in one embodiment can be used in other embodiments in any appropriate combination. For example, any of the various components described herein and/or depicted in the Figures may be combined, interchanged, or excluded from other embodiments.

"A system having at least one of A, B, and C" (likewise "a system having at least one of A, B, or C" and "a system having at least one of A, B, C") includes systems that have A alone, B alone, C alone, A and B together, A and C together, B and C together, and/or A, B, and C together, etc.

Now specifically referring to FIG. 1, an example system 10 is shown, which may include one or more of the example devices mentioned above and described further below in accordance with present principles. The first of the example devices included in the system 10 is an example consumer electronics (CE) device 12. The CE device 12 may be, e.g., a computerized Internet enabled ("smart") telephone, a tablet computer, a notebook computer, a wearable computerized device such as e.g. computerized Internet-enabled watch, a computerized Internet-enabled bracelet, other computerized Internet-enabled devices, a computerized Internet-enabled music player, computerized Internet-enabled head phones, a computerized Internet-enabled implantable device such as an implantable skin device, etc., and even e.g. a computerized Internet-enabled television (TV), a computer game console, a computer game controller. It is to be understood that the CE device 12 is an example of a device that may be configured to undertake present principles (e.g., communicate with other devices to undertake present principles, execute the logic described herein, and perform any other functions and/or operations described herein).

Accordingly, to undertake such principles the CE device 12 can be established by some or all of the components shown in FIG. 1. For example, the CE device 12 can include one or more touch-enabled displays 14, and one or more speakers 16 for outputting audio in accordance with present principles. The example CE device 12 may also include one or more network interfaces 18 for communication over at least one network such as the Internet, a WAN, a LAN, etc. under control of one or more processors 20 such as but not limited to a DSP. It is to be understood that the processor 20 controls the CE device 12 to undertake present principles, including the other elements of the CE device 12 described herein. Furthermore, note the network interface 18 may be, e.g., a wired or wireless modem or router, or other appropriate interface such as, e.g., a wireless telephony transceiver, Wi-Fi transceiver, a Bluetooth transceiver, etc.

In addition, to the foregoing, the CE device 12 may also include one or more input ports 22 such as, e.g., a USB port to physically connect (e.g., using a wired connection) to another CE device and/or a head-mounted device (HMD) 24 such as a virtual reality (VR) or augmented reality (AR) HMD or even a speaker-only headphone that can be worn by a person 26. The CE device 12 may further include one or more computer memories 28 such as disk-based or solid-state storage that are not transitory signals on which is stored electronic information such HRTF-related FIR filters.

The CE device 12 may communicate with, via the ports 22 or wireless links via the interface 18, microphones 30 in the earpiece of the HMD 24, speakers 32 in the HMD 24, and hearing aids 34 worn under the HMD 24 to communicate information consistent with disclosure below. It is to be noted that the HMD 24 typically includes additional CE device components mirroring those of the CE device 12 shown in FIG. 1, such as processors, wireless transceivers, and storage that may contain HRTFs for implementation of the HRTFs within the HMD 24 on audio streams received from the CE device 12.

The CE device 12 when implemented by a computer game console is an example source of computer simulations, at least the audio from which can be played on the HMD 24. Another example source of computer simulations such as computer games is a remote game server.

To enable end users to access their personalized HRTF files, the files, once generated, may be stored on a portable memory 38 and/or cloud storage 40 (typically separate devices from the CE device 12 in communication therewith, as indicated by the dashed line), with the person 26 being given the portable memory 38 or access to the cloud storage 40 so as to be able to load (as indicated by the dashed line) his personalized HRTF into a receiver such as a digital signal processor (DSP) 41 of playback device 42 of the end user. A playback device may include one or more additional processors such as a second digital signal processor (DSP) with digital to analog converters (DACs) 44 that digitize audio streams such as stereo audio or multi-channel (greater than two track) audio, convoluting the audio with the HRTF information on the memory 38 or downloaded from cloud storage. This may occur in one or more headphone amplifiers 46 which output audio to at least two speakers 48, which may be speakers of the headphones 24 that were used to generate the HRTF files from the test tones. U.S. Pat. No. 8,503,682, owned by the present assignee and incorporated herein by reference, describes a method for convoluting HRTF onto audio signals. Note that the second DSP can implement the FIR filters that are originally established by the DSP 20 of the CE device 12, which may be the same DSP used for playback or a different DSP as shown in the example of FIG. 1. Note further that the playback device 42 may or may not be a CE device.

In some implementations, HRTF files may be generated by applying a finite element method (FEM), finite difference method (FDM), finite volume method, and/or another numerical method, using 3D models to set boundary conditions.

Figure 2:
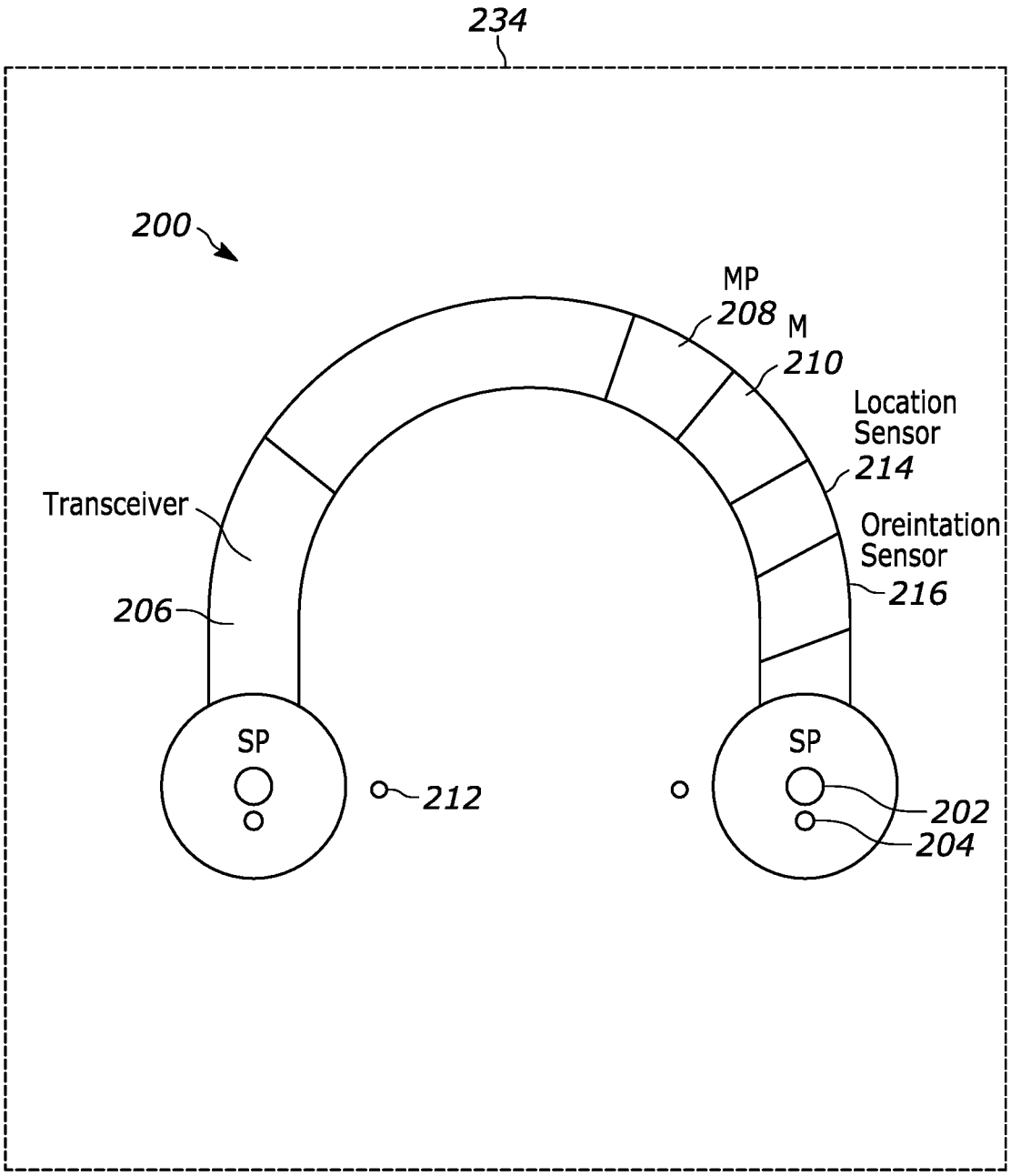
FIG. 2 illustrates an example HMD.

FIG. 2 shows a non-limiting example HMD 200 with left and right earphone speakers 202. In lieu of or adjacent to each speaker 202 may be a respective microphone 204. In the example shown, the HMD 200 may include one or more wireless transceivers 206 communicating with one or more processors 208 accessing one or more computer storage media 210. Hearing aids 212 may be worn independently or with the HMD 200. The HMD 200 may include one or more position or location sensors 214 such as global positioning satellite (GPS) receivers and one or more pose sensors 216 such as a combination of accelerometers, magnetometers, and gyroscopes to sense the location and orientation of the HMD in space.

Present principles may be executed by any one or more of the processors described herein lone or working in concert with other processors.

Figure 3:
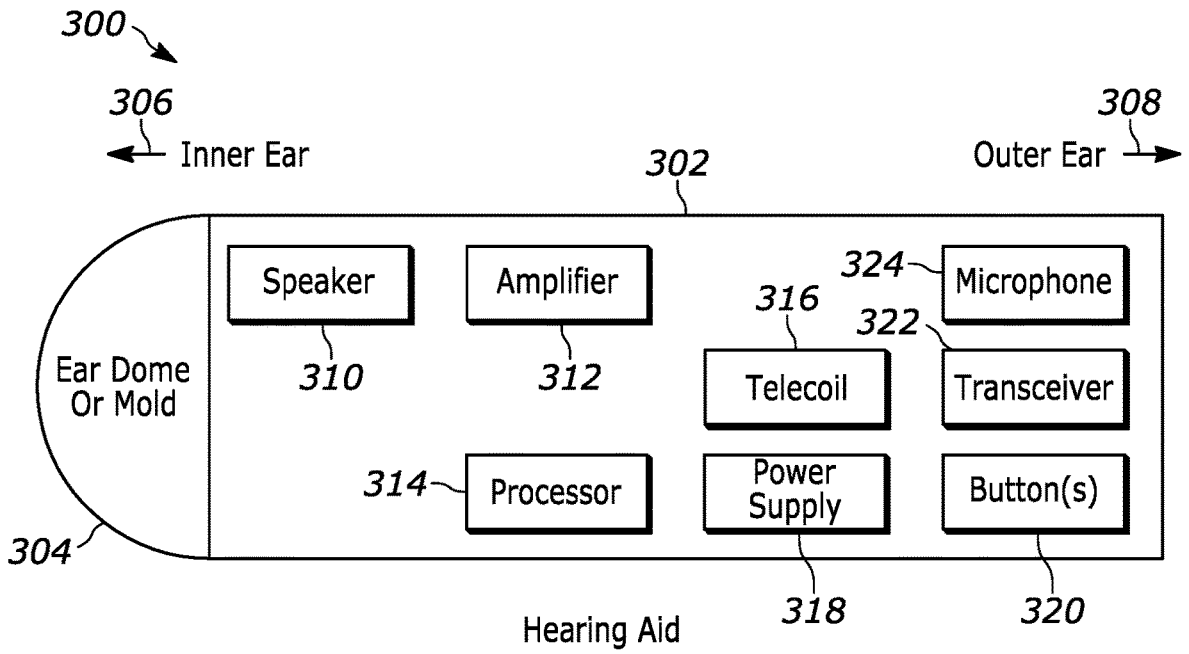
FIG. 3 illustrates an example hearing aid.

FIG. 3 illustrates an example non-limiting hearing aid 300, it being understood that a person typically uses one hearing aid per ear. The hearing aid 300 includes a housing 302 the distal end 304 (end that goes into the ear first as indicated at 306) of which is configured to engage the ear canal. The distal end 304 may be, e.g., an ear dome or mold. Opposite the distal end 304, which may be regarded as an output end since sound emanates from there, is a proximal end as indicated at 308, which may be regarded as an input end since sound enters the hearing aid at or near the proximal end.

Accordingly, at least one speaker 310 is located in the housing 302 at the distal end 304 to provide sound through the distal end 304 as amplified by at least one amplifier 312 controlled by at least one processor 314. Like many hearing aids, the hearing aid 300 may include one or more telecoils 316. The components of the hearing aid 300 may be powered by at least one power supply 318 such as a direct current (DC) battery.

The hearing aid 300 may also include one or more manipulable controls such as a button 320 to input or change settings such as volume. One or more wireless transceivers 322 also may be provided. In an example, the wireless transceiver 322 includes a Bluetooth transceiver, it being understood that other technologies such as Wi-Fi or wireless telephony may be used. To receive input sound for processing, one or more microphones 324 may be in the housing 302, typically at the proximal end.

Figure 4:
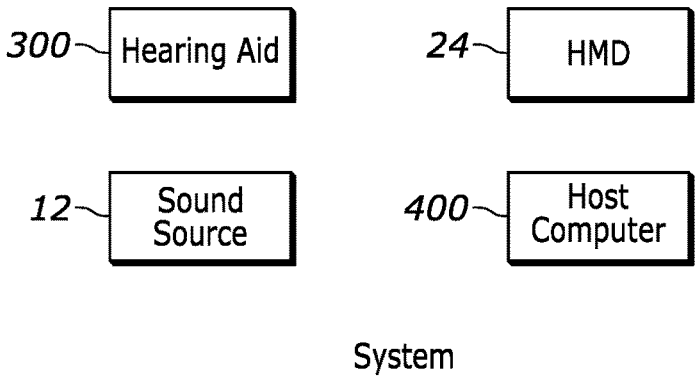
FIG. 4 illustrates an example system to determine a HRTF using a hearing aid such as the hearing aid in FIG. 3.

FIG. 4 illustrates that an example system for generating a personalized HRTF for a person wearing the hearing aid 300 may include the hearing aid 300, the HMD 24 in FIG. 1, the sound source 12 in FIG. 1, and a host computer 400 that may receive wireless signals from the hearing aid 300 via the transceiver 322. The host computer 400 may be established by, e.g., a desktop computer, laptop computer, tablet computer, or cell phone with appropriate displays, processors, and computer storage media as well as appropriate communication interfaces. The components in FIG. 4 may be separate from each other as shown or may be integrated in appropriate cases, e.g., the sound source 12 may include the HMD 24 and/or host computer 400.

Figure 5:
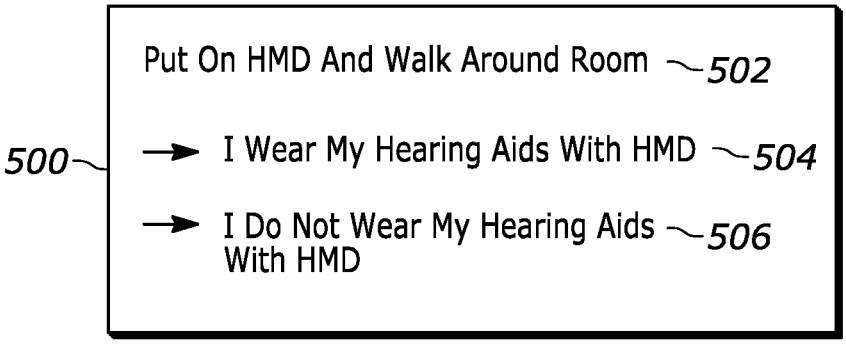
FIG. 5 is a screen shot of an example user interface (UI) for allowing a user to define a HRTF.

FIG. 5 illustrates an example UI that may be presented on a display 500 such as any of the displays described herein to prompt at 502 a person to don the HMD and walk around a room. The UI may also include two selectors 504, 506, the first for indicating that the person intends to wear the hearing aid 300 while also wearing the HMD, the second to indicate that the person intended to listen to audio using the HMD without the hearing aid in place, for purposes to be shortly disclosed.

Figure 6:
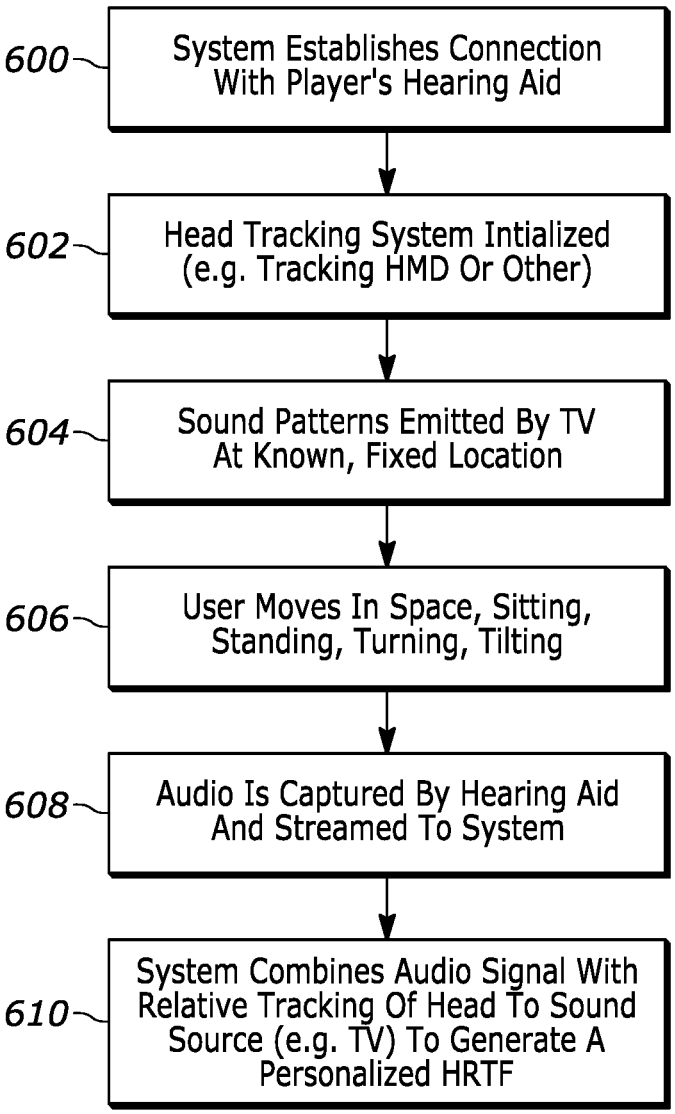
FIG. 6 is a flowchart in example flow chart format of example logic consistent with present principles.

FIG. 6 illustrates example logic. Commencing at block 600, a connection such as a Bluetooth communication channel is established between the hearing aid 300 and, e.g., the host computer 400 shown in FIG. 4. Moving to block 602, the head tracking system in the HMD 24 is initialized. In lieu of the HMD to track the listener's head, other techniques such as computer vision using a camera on, e.g., the host computer 400 may be used.

Proceeding to block 604, sound patterns such as HRTF test sounds are emitted by the source 12 (which may be a TV controlled via wired or wireless signals by the host computer 400), which typically is at a known location derived from, e.g., a GPS receiver or other position sensor on the source and provided to the host computer via a wired or wireless communication path. Block 606 indicates that the listener moves in space according to the prompt 502 in FIG. 5, which may include walking, tilting, and turning the head, sitting down, and standing up, etc.

As the listener moves, his or her head is tracked, e.g., using the orientation and location sensors on the HMD 24, which sends head tracking signals to the host computer 400, typically over a wireless path. Simultaneously, at block 608 audio is captured by the hearing aid 300 and indications of audio detection are sent to the host computer via streaming such as Bluetooth streaming.

It is to be understood that both the test sounds emitted by the sound source 12 and the audio detection signals sent by the hearing aid 300 to the host computer 400 are time-stamped, as are the head tracking signals sent from the HMD 24 to the host computer 400. That is, audio transmission and detection and head tracking are known and include the same or equivalent parameters as is available to a HRTF generation computer used to generate a HRTF for a person in an anechoic chamber having a series to fixed speakers located around the chamber. For every test tone emitted, the time and location of the emission (the sound source 12) is known, as are the times and locations of the detections are known as is the user's head orientation and location relative to the sound source 12. Block 610 accordingly indicates that using this information, including the head tracking relative to the sound source and the times of emission and detection of the test audio tones, a personalized HRTF is generated for the person.

Recall that FIG. 5 includes an example technique for allowing the listener to specify whether in practice the listener intends to wear the hearing aid 300 or not while listening the audio using the HMD 24 or other headphones processed through the personalized HRTF generated at block 610. When the listener indicates that the hearing aid will be worn, the wireless signals from the hearing aid can represent signals at an output of the microphone (the input end of the hearing aid). This produces a HRTF useful for processing audio played on the HMD 24 while the person also is wearing the hearing aid.

On the other hand, when the listener indicates that the hearing aid will not be worn, the wireless signals from the hearing aid can represent signals at an input of the speaker of the hearing aid (the output end of the hearing aid). This produces a HRTF useful for playing audio on the HMD when the listener is not wearing the hearing aid.

It is to be understood that the hearing aid may send both signals (detection signals at input and output) and the host computer may select the signal according to the listener's selection, e.g., from FIG. 5, or the hearing aid may be instructed to send only the relevant detection signal to the host computer.

Figure 7:
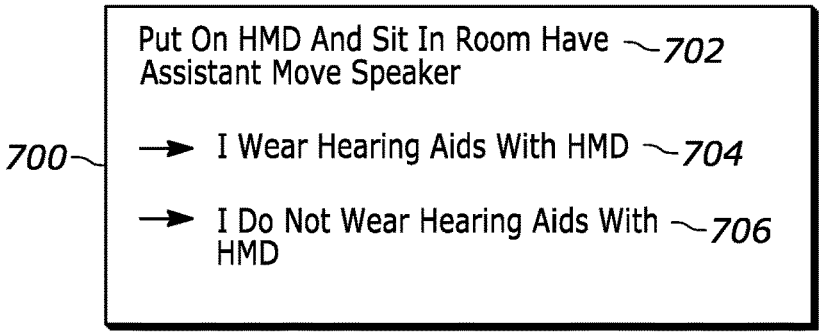
FIG. 7 is a screen shot of an alternate example user interface (UI) for allowing a user to define a HRTF.

In an alternative embodiment, rather than the user moving their head through space, the sound source can be moved to generate the HRTF. FIG. 7 illustrates.

A UI may be presented on a display 700 such as any of the displays herein to prompt at 702 the listener to wear the HMD 24 and sit in a room (or simply sit in the room without the HMD on when computer vision, e.g., from imaged generated by the same smart phone emitting the test tones is used for head tracking), with an assistant tasked to move a speaker such as a speaker on a mobile telephone. Selections 704, 706 that are equivalent to the selectors 504, 506 in FIG. 5 may be provided.

Figure 8:
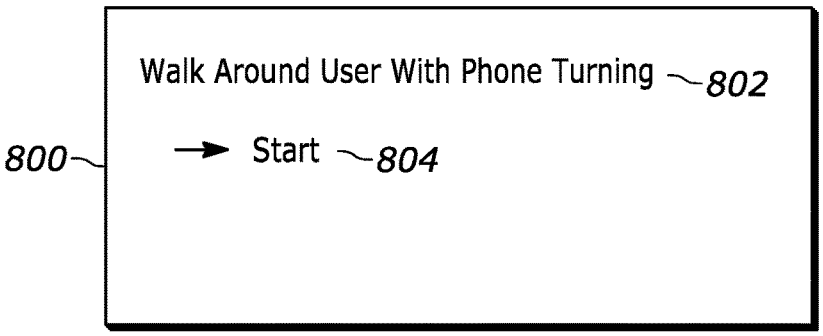
FIG. 8 is a screen shot of another example user interface (UI) for allowing a user to define a HRTF.
Figure 9:
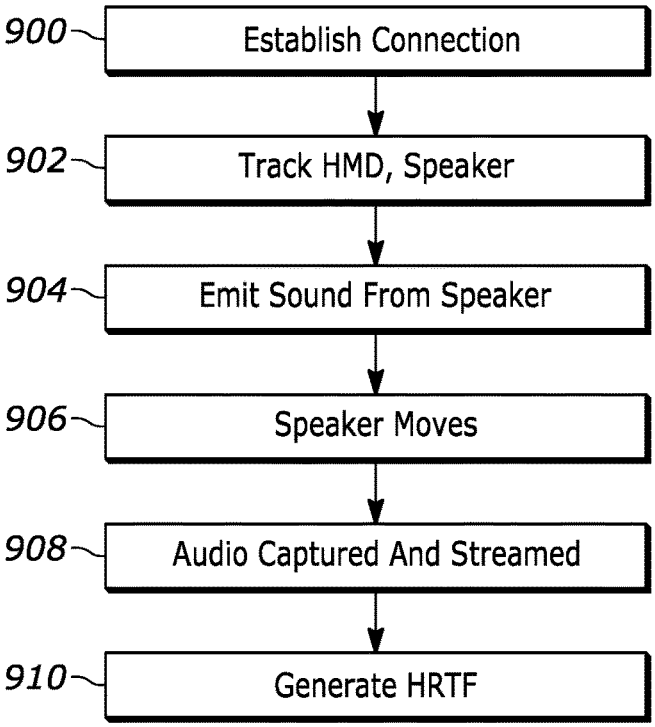
FIG. 9 is a flowchart in example flow chart format of alternate example logic consistent with present principles.

FIG. 8 illustrates a UI that may be provided on any display 800 herein to prompt at 802 the assistant to walk around the listener holding a sound source such as a smart phone. When ready, the assistant can select start 804 to initialize the logic of FIG. 9.

Commencing at block 900, a wireless connection is established between, e.g., the smart phone, hearing aid, HMD (when used), and host computer (if different from the smart phone). Head tracking and speaker tracking are executed at block 902. The speaker may be tracked using the GPS location information from the smart phone/sound source. Blocks 904 and 906 indicate that the sound source emits test tones as it moves, which are captured at block 908 by the hearing aid 300. This captures the relative transformation from the sound source to the head as well as the signal into or out of the hearing aid to generate a personalized HRTF at block 910.

While the particular embodiments are herein shown and described in detail, it is to be understood that the subject matter which is encompassed by the present invention is limited only by the claims.

What is claimed is:

1. A system comprising:

at least one computer medium that is not a transitory signal and that comprises instructions executable by at least one processor to:

receive wireless signals from at least one hearing aid;

receive at least a first selection signal;

based at least in part on the wireless signals and the first selection signal, establish a first head-related transfer function (HRTF) configured for an input end of the hearing aid;

receive at least a second selection signal; and based at least in part on the wireless signals and the second selection signal, establish a second head-related transfer function (HRTF) configured for an output end of the hearing aid.

2. The system of claim 1, wherein the hearing aid comprises:

at least one speaker;

at least one amplifier configured to send signals to the speaker;

at least one microphone configured to provide signals to the amplifier;

at least one wireless transceiver; and at least one distal end configured to engage an ear canal of the person.

3. The system of claim 2, wherein the wireless signals from the hearing aid represent signals at an output of the microphone.

4. The system of claim 3, wherein the first HRTF is configured for processing audio played by a head-mounted device (HMD) worn by the person also wearing the hearing aid.

5. The system of claim 2, wherein the wireless signals from the hearing aid represent signals at an input of the speaker of the hearing aid.

6. The system of claim 5, wherein the second HRTF is configured for processing audio played by a head-mounted device (HMD) worn by the person not also wearing the hearing aid.

7. The system of claim 1, wherein the instructions are executable to:

receive position signals from a head-mounted device (HMD) worn by the person;

receive signals from a source of sound at a location and emitting audio detected by the hearing aid; and determine at least one of the HRTFs based at least in part on the position signals and the signals from the source of sound.

8. The system of claim 7, wherein the HMD moves, and the source of sound is stationary as it sends the signals from the source of sound.

9. The system of claim 1, wherein the instructions are executable to:

present an interface operable to input the first and second selection signals.

10. A method, comprising:

receiving wireless signals from at least one hearing aid;

receiving at least a first selection signal;

based at least in part on the wireless signals and the first selection signal, establishing a first head-related transfer function (HRTF) configured for an input end of the hearing aid;

receiving at least a second selection signal; and based at least in part on the wireless signals and the second selection signal, establishing a second HRTF configured for an output end of the hearing aid.

11. The method of claim 10, wherein the hearing aid comprises an input end and an output end, at least the first HRTF being configured based on a location on the hearing aid spaced from the input end, wherein the signals represent sound at the input end received from a source.

12. The method of claim 10, wherein the hearing aid comprises an input end and an output end, at least the first HRTF being configured based on a location on the hearing aid spaced from the input end, wherein the signals represent sound at the output end received from a source.

13. The method of claim 10, comprising:

receiving signals from a position sensor worn by a person wearing the hearing aid as the person ambulates;

receiving signals from a source of sound detected by the hearing aid; and using the signals from the position sensor, signals from the source of sound, and signals from the hearing aid to determine at least the first HRTF.

14. The method of claim 10, comprising:

receiving signals indicating a location of a person wearing the hearing aid;

receiving signals from a moving source of sound detected by the hearing aid; and using the signals indicating the location of the person, signals from the moving source of sound, and signals from the hearing aid to determine at least the first HRTF.

15. An assembly, comprising:

at least one processor;

at least one head-mounted device (HMD) wearable by a person for playing audio from a source of sound for consumption of the audio by the person, the audio being provided by the processor executing a head-related transfer function (HRTF) on the audio, the HRTF being based on test sounds emitted by a sound source and audio detection signals representing the test sounds sent by a hearing aid, the test sounds and audio detection signals being time-stamped and provided to a HRTF generation computer to generate the HRTF for a person wearing the hearing aid.

16. The assembly of claim 15, wherein the processor is in the HMD.

17. The assembly of claim 15, wherein the processor is in the hearing aid.

18. The assembly of claim 15, wherein the processor is in the source of sound.

19. The assembly of claim 15, wherein the signals from the hearing aid represent signals at an input end of the hearing aid.

20. The assembly of claim 15, wherein the signals from the hearing aid represent signals at an output end of the hearing aid.

* * * * *